US010857824B2

(12) United States Patent
Bunch

(10) Patent No.: US 10,857,824 B2
(45) Date of Patent: Dec. 8, 2020

(54) SOLVENT RESISTANT GLOSSY PRINTABLE SUBSTRATES AND THEIR METHODS OF MANUFACTURE AND USE

(71) Applicant: Neenah Paper, Inc., Alpharetta, GA (US)

(72) Inventor: Abdu Yohance Bunch, Marquette, MI (US)

(73) Assignee: Neenah, Inc., Alpharetta, GA (US)

( * ) Notice: Subject to any disclaimer, the term of this patent is extended or adjusted under 35 U.S.C. 154(b) by 0 days.

(21) Appl. No.: 15/606,140

(22) Filed: May 26, 2017

(65) Prior Publication Data

US 2017/0341449 A1 Nov. 30, 2017

Related U.S. Application Data

(60) Provisional application No. 62/342,622, filed on May 27, 2016.

(51) Int. Cl.

| | |
|---|---|
| ***B41M 5/52*** | (2006.01) |
| ***B41M 5/50*** | (2006.01) |
| ***B41J 2/01*** | (2006.01) |

(52) U.S. Cl.

CPC ..... *B41M 5/52* (2013.01); *B41J 2/01* (2013.01); *B41M 5/5218* (2013.01); *B41M 5/5245* (2013.01); *B41M 5/5254* (2013.01); *B41M 5/508* (2013.01); *B41M 5/5227* (2013.01); *B41M 5/5281* (2013.01)

(58) Field of Classification Search

None

See application file for complete search history.

(56) References Cited

U.S. PATENT DOCUMENTS

| | | | | |
|---|---|---|---|---|
| 5,104,721 | A | 4/1992 | Sun | |
| 5,721,309 | A | 2/1998 | Sharma et al. | |
| 5,985,425 | A | 11/1999 | Tomizawa et al. | |
| 6,605,337 | B1 * | 8/2003 | Mori | B41M 3/008 428/195.1 |

(Continued)

FOREIGN PATENT DOCUMENTS

| | | |
|---|---|---|
| JP | 2006181786 | 7/2006 |
| WO | WO 2001/81078 | 11/2001 |

OTHER PUBLICATIONS

International Search Report, dated Sep. 12, 2017.

(Continued)

*Primary Examiner* — Alejandro Valencia

(74) *Attorney, Agent, or Firm* — Meunier Carlin & Curfman LLC

(57) ABSTRACT

Printable substrates that provide a glossy printable surface with solvent resistance are provided. The printable substrate may include a base sheet having a first surface and a second surface, and a printable coating on the first surface. The printable coating includes a film-forming binder mixture, a crosslinking agent, a partially hydrolyzed polyvinyl alcohol, a first plurality of first silicon dioxide microparticles, a second plurality of second silicon dioxide microparticles, and a cationic dye fixative. The printable substrate may have a gloss level of about 50 to about 60 based on measurement of a gloss meter set with an angle of measurement of 75 degree on the external surface of the printable coating.

23 Claims, 5 Drawing Sheets

(56) References Cited

U.S. PATENT DOCUMENTS

| | | | | |
|---|---|---|---|---|
| 6,924,089 | B2 * | 8/2005 | Oya | G03C 1/49827 430/264 |
| 7,070,834 | B2 * | 7/2006 | Kasahara | B41M 5/5227 427/177 |
| 7,507,439 | B2 | 3/2009 | Chen et al. | |
| 8,314,175 | B2 * | 11/2012 | Takahashi | B41M 5/502 524/405 |
| 8,877,325 | B2 * | 11/2014 | Gringoire | C09D 133/00 428/195.1 |
| 9,441,095 | B2 * | 9/2016 | Sueyoshi | C09C 1/30 |
| 2013/0115387 | A1 | 5/2013 | Dolsey | |
| 2015/0241441 | A1 * | 8/2015 | Chen | C23C 18/1266 436/95 |

OTHER PUBLICATIONS

Office Action dated Jul. 6, 2020 for counterpart Chinese patent application No. 2017800451597, and its English Language translation, 20 pages.

* cited by examiner

SOLVENT RESISTANT GLOSSY PRINTABLE SUBSTRATES AND THEIR METHODS OF MANUFACTURE AND USE

PRIORITY INFORMATION

The present application claims priority to U.S. Provisional Patent Application Ser. No. 62/342,622 titled "Solvent Resistant Glossy Printable Substrates and Their Methods of Manufacture and Use" filed on May 27, 2016, the disclosure of which is incorporated by reference herein.

BACKGROUND OF THE INVENTION

The increased availability of printers has allowed ordinary consumers to make and print their images on a variety of substrates such as papers and labels. The ink composition printed according to these processes can vary with the type of printer utilized. No matter, the inks printed onto papers and labels can be exposed to various environments, particularly when applied to a label product. For example, the substrate can be exposed to harsh chemicals (e.g., organic solvents). This exposure to some environments can cause the ink to fade and/or be removed from the surface of the substrate.

Glossy printing surfaces are desired in certain applications to provide a desired esthetic (e.g., transparency, conformability, breathability, etc.) to the printing surface. However, obtaining solvent resistance is particularly difficult for glossier printing surfaces. For instance, the components of a matte printing surface may have good solvent resistance, but generally lack the ability to be transformed into a glossy printing surface while keeping their solvent resistance. For example, many glossy labels have very low levels of solvent resistance, especially for resistance to organic based solvents like isopropyl and methanol.

Additionally, glossy printing surfaces are typically more difficult to print on, especially for a versatile printing surface capable of quality printing in both ink-jet and laser methods. Printable surfaces engineered for ink-jet printing processes are typically non-crosslinked or lightly-crosslinked polymeric layers that enable ink penetration into the printable surface during the printing process since crosslinking typically also leads to higher glass transition temperatures and less affinity of the printable layer for the ink-jet ink, leading to less durability in the printed material.

Therefore, a need exists for a glossy substrate (e.g., a label) having improved printable characteristics and durability of printed inks on its surface.

SUMMARY

Objects and advantages of the invention will be set forth in part in the following description, or may be obvious from the description, or may be learned through practice of the invention.

Printable substrates are generally provided that provide a glossy printable surface with solvent resistance. For example, in one embodiment, the printable substrate includes a base sheet having a first surface and a second surface, and a printable coating on the first surface. The printable coating includes a film-forming binder mixture, a crosslinking agent, a partially hydrolyzed polyvinyl alcohol, a first plurality of first silicon dioxide microparticles, a second plurality of second silicon dioxide microparticles, and a cationic dye fixative. In one embodiment, the printable substrate has a gloss level of about 50 to about 60 based on measurement of a gloss meter set with an angle of measurement of 75 degree on the external surface of the printable coating.

Generally, the first silicon dioxide microparticles and the second silicon dioxide microparticles have different surface areas. For example, the first silicon dioxide microparticles can have an average diameter that is smaller than an average diameter of the second silicon dioxide microparticles.

In particular embodiments, the first silicon dioxide microparticles have an average diameter of from about 3 μm to about 7 μm, and/or the second silicon dioxide microparticles have an average diameter of from about 8 μm to about 12 μm. Additionally, the first plurality of silicon dioxide microparticles constitute about 60% to about 80% of a total weight of all of the inorganic microparticles present in the printable coating. Similarly, the second plurality of silicon dioxide microparticles can constitute about 20% to about 40% of a total weight of all of the inorganic microparticles present in the printable coating.

Methods are also generally provided for forming an image on a printable substrate. For example, an ink composition can be printed (e.g., ink jet and/or laser printing) onto the external surface of a printable substrate, such as described above.

Printable coating precursor compositions are also generally provided. Such printable coating precursor compositions can be utilized to form a printable coating on a base sheet. In one embodiment, the printable coating precursor composition includes a film-forming binder mixture, a crosslinking agent, a partially hydrolyzed polyvinyl alcohol, a first plurality of first silicon dioxide particles, a second plurality of second silicon dioxide particles, a cationic dye fixative, and water. The first silicon dioxide microparticles and the second silicon dioxide microparticles have different surface areas.

Methods are also generally provided for forming a printable substrate. In one embodiment, the method includes applying the printable coating precursor, such as described above, onto a surface of a base substrate and curing the printable coating precursor to crosslink the film-forming binder mixture and the partially hydrolyzed polyvinyl alcohol.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which.

Figure 1:
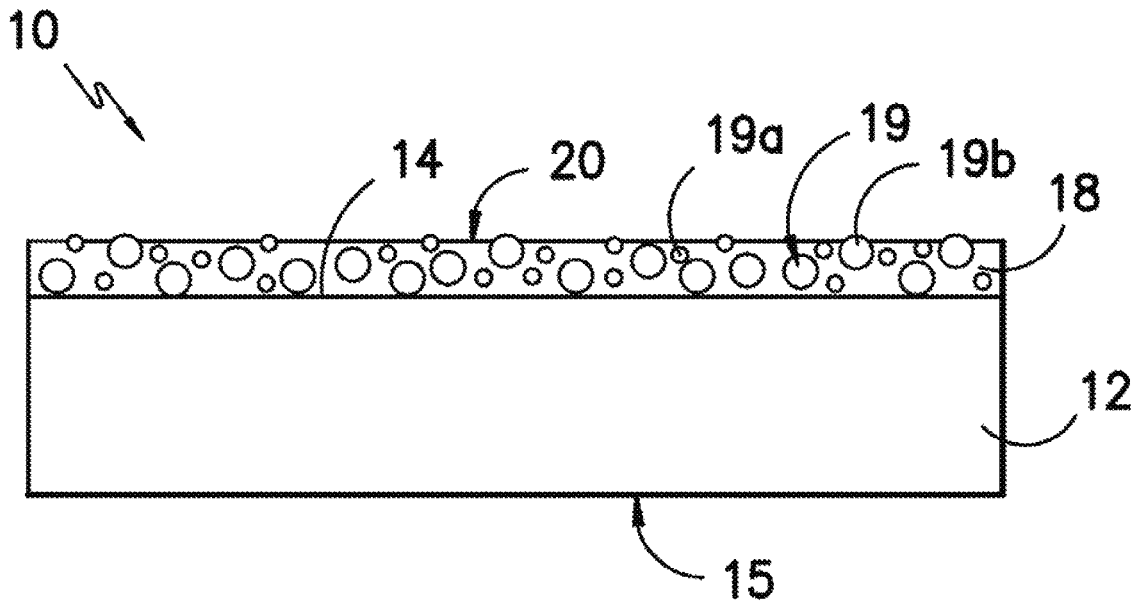
FIG. 1 shows an exemplary printable substrate 10 having a printable coating 18 on a first surface 14 of the base sheet 12.

Repeat use of reference characters in the present specification and drawings is intended to represent the same or analogous features or elements of the present invention.

Definitions

As used herein, the term "printable" is meant to include enabling the placement of an image on a material, especially through the use of ink-jet inks.

As used herein, the term "polymeric film" is meant to include any sheet-like polymeric material that is extruded or otherwise formed (e.g., cast) into a sheet. Typically, polymeric films do not contain discernable fibers.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

The term "organic" is used herein to refer to a class of chemical compounds that are comprised of carbon atoms. For example, an "organic polymer" is a polymer that includes carbon atoms in the polymer backbone.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

As used herein, the prefix "micro" refers to the micrometer scale (i.e., from about 1 μm to about 999 μm). Particles having a size of greater than 1,000 nm (i.e., 1 micrometer or micron) are generally referred to as "microparticles", since the micrometer scale generally involves those particles having an average diameter of greater than 1 μm.

In the present disclosure, when a layer is being described as "on" or "over" another layer or substrate, it is to be understood that the layers can either be directly contacting each other or have another layer or feature between the layers, unless otherwise stated. Thus, these terms are simply describing the relative position of the layers to each other and do not necessarily mean "on top of" since the relative position above or below depends upon the orientation of the device to the viewer.

DETAILED DESCRIPTION

Reference now will be made to the embodiments of the invention, one or more examples of which are set forth below. Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

Glossy printable substrates (e.g., glossy printable label substrates) are generally provided that exhibit good durability with respect to an ink-jet printing(s) on the printable substrate, even in harsh environments such as exposure to organic solvents, etc. Additionally, the print quality formed on the coated label substrates can be of excellent quality such that virtually any image can be printed on the substrates.

In particular, the printable substrates include a base sheet having a glossy print coating on one of its surfaces. In one particular embodiment, the glossy print coating is directly on the surface of the base sheet (e.g., without any tie coating therebetween). Referring to FIG. 1, an exemplary printable substrate 10 having printable coating 18 over a first surface 14 of a base sheet 12 is generally shown. The printable coating 18 is positioned so as to define an exterior surface 20 of the printable substrate 10. As shown, the printable coating 18 includes a mixture of inorganic particles 19 (e.g., silicon dioxide particles), shown as a first plurality of first inorganic particles 19*a* and a second plurality of second inorganic particles 19*b*.

The printable coating 18 can generally be a crosslinked materials to form a printable substrate 10 that is solvent resistant, especially to those organic solvents that may otherwise solubilize the binder in the print coating if not crosslinked. Without wishing to be bound by any particular theory, it is believed that the printable coating 18 yields a highly solvent resistant surface that remains printable by conventional printing processes, including ink-jet printing.

In one particular embodiment, the printable substrate 10 has a gloss level of about 50 to about 60 (based on measurement of a gloss meter set with an angle of measurement of 75 degree) on the external surface of the printable coating 18 prior to any printing thereon. A gloss meter (also glossmeter) is an instrument which is used to measure specular reflection gloss of a surface. Gloss is determined by projecting a beam of light at a fixed intensity and angle onto a surface and measuring the amount of reflected light at an equal but opposite angle. For example, a suitable gloss meter is Model T480A available commercially from Technidyne Corporation. The range above is based on a measurement of a 75 degree angle of measurement).

At such a gloss level, the printable substrate looks significantly different than a matte inkjet coated film which typically has a gloss ranging from 5 to 10, but will not be so glossy that end users may complain about glare. Such a gloss level allows for the desired aesthetics for the resulting printable substrate 10. For example, any underlying pattern and/or texture on the base sheet 12 may be retained or enhanced through the glossy printable coating 18. In one embodiment, for instance, the printable coating 18 may have a transparency of about 50% to about 95% such that the underlying base sheet 12 is visible through the printable coating 18.

Additionally, the printable coating can have other desirable properties, such as low bleed and dry time along with good color density for inkjet and good toner adhesion for laser printing, and also good barcode readability for both print methods. The pigment/binder ratio of the glossy coating is, in one embodiment, much lower than the ratio used in matte printable coatings.

I. Printable Coating

The printable coating 18 can generally be positioned on the base sheet 12 in order to form an external, printable surface on the resulting printable substrate. Specifically, the printable coating can improve the printability of the label substrate. Additionally, any printing on the printable coating can be durable and can withstand harsh conditions (e.g., exposure to moisture and/or harsh chemical environments) and can exhibit an increased scratch and abrasion resistance.

The printable coating can act as an anchor to hold the printed image (e.g., formed by a ink-jet based ink) on the coated label substrate. Thus, the printed substrate can have increased durability in a variety of environments. In one particular embodiment, the print coating can provide a solvent resistant printable surface, particularly for organic solvents such as alcohols, kerosene, toluene, xylenes (e.g., a mixture of the three isomers of dimethylbenzene), benzene, oils, etc.

The printable coating, in one particular embodiment, includes a plurality of inorganic microparticles 19 and a crosslinked material formed from a film-forming binder mixture (e.g., a mixture of crosslinkable polymeric binders including a urethane component, an acrylic component, and a polyvinyl alcohol component), a crosslinking agent, and a partially hydrolyzed polyvinyl alcohol. For example, the printable coating can comprise about 1% by weight to about 10% by weight of the inorganic microparticles (e.g., about 2% by weight to about 7% by weight), about 65% by weight to about 85% by weight of the film-forming binder mixture (e.g., about 70% by weight to about 85% by weight), about 1% by weight to about 10% by weight of the crosslinking agent (e.g., about 3% by weight to about 8% by weight), and about 5% by weight to about 25% by weight of the partially hydrolyzed polyvinyl alcohol (e.g., about 10% by weight to about 20% by weight). Each of these components is discussed in greater detail below.

The inorganic microparticle 19 can be, in one particular embodiment, a metal-oxide microparticle, such as silicon dioxide ($SiO_2$), aluminum oxide ($Al_2O_3$), aluminum dioxide ($AlO_2$), zinc oxide (ZnO), and combinations thereof. Without wishing to be bound by theory, it is believed that the inorganic microparticles 19 add affinity for the inks of the printed image to the printable coating. For example, it is believed that the metal-oxide porous microparticles (e.g., $SiO_2$) can absorb the ink liquid (e.g., water and/or other solvents) quickly and can retain the ink molecules upon drying, even after exposure to an organic solvent. Additionally, it is believe that metal-oxide microparticles (e.g., $SiO_2$) can add an available bonding site at the oxide that can bond (covalent bonds or ionic bonds) and/or interact (e.g., van der Waals forces, hydrogen bonding, etc.) with the ink binder and/or pigment molecules in the ink. This bonding and/or interaction between molecules of the ink composition and the oxide of the microparticles can improve the durability of the ink printed on the printable surface.

The inorganic microparticles 19 can have an average diameter on the micrometer (micron or μm) scale, such as from about 3 μm to about 12 μm. Such microparticles can provide a sufficiently large surface area to interact with the ink composition applied to the printable coating 18, while remaining sufficiently smooth on the exposed surface 20. Additionally, microparticles that are too large can lead to grainy images formed on the printable coating 18 and/or reduce the sharpness of any image applied thereto.

In one particular embodiment, the printable coating can include a first plurality of inorganic microparticles 19*a* having a first average diameter and a second plurality of inorganic microparticles 19*b* having a second average diameter, with the first average diameter being smaller than the second average diameter. For example, the first average diameter can be about 3 μm to about 7 μm (e.g., about 4 to about 6), and the second average diameter can be about 8 μm to about 12 μm (e.g., about 8 to about 10, such as about 8 to about 9). In this embodiment, the first plurality (having smaller average diameters) add a glossy effect to the printable coating, while the second plurality (having larger average diameters) can help to quickly absorb the ink into the printable coating 18. For example, it is believed that the larger particles can help speed up the intake and/or drying times of the ink (to prevent bleeding).

In one particular embodiment, a higher weight percent of the first plurality of inorganic microparticles 19*a* (having smaller average diameters) can be present in the layer than the second plurality of inorganic microparticles 19*b* (having larger average diameters). For example, the first plurality of inorganic microparticles 19*a* can constitute about 60% to about 80% of the total weight of all of the inorganic microparticles 19 present in the coating 18. Similarly, the second plurality of inorganic microparticles 19*b* can constitute about 20% to about 40% of the total weight of all of the inorganic microparticles 19 present in the coating 18. It is also believed, without wishing to be bound by any particular theory, that such a ratio of particles 19 can allow the crosslinkable polymeric binder to form a stronger coating through its ability to better hold the smaller particles than the larger particles.

As stated, a crosslinking agent is present in the printable coating 18 to ensure that a highly crosslinked coating is formed. In particular, the film-forming binder mixture can react with the crosslinking agent to form a 3-dimensional crosslinked material around the microparticles 19 to hold and secure the microparticles 19 in place in the printable coating 18.

Generally, it is contemplated that any pair of film-forming binder mixture and crosslinking agent that reacts to form the 3-dimensional polymeric structure may be utilized. Particularly suitable crosslinking polymeric binders include those that contain reactive carboxyl groups. Exemplary crosslinking binders that include carboxyl groups include acrylics, polyurethanes, ethylene-acrylic acid copolymers, and so forth. Other desirable crosslinking binders include those that contain reactive hydroxyl groups. Cross-linking agents that can be used to crosslink binders having carboxyl groups include polyfunctional aziridines, epoxy resins, carbodiimide, oxazoline functional polymers, and so forth. Crosslinking agents that can be used to crosslink binders having hydroxyl groups include melamine-formaldehyde, urea formaldehyde, amine-epichlorohydrin, multi-functional isocyanates, and so forth.

In one particular embodiment, the crosslinkable polymeric material includes a mixture of at least an acrylic component (e.g., an ethylene acrylic acid copolymer), a urethane component, and a polyvinyl alcohol component. It is believed, without wishing to be bound by any particular theory, that the acrylic component and a urethane component can provide solvent resistance to the printable coating. The polyvinyl alcohol component of the crosslinkable polymeric material is, in one embodiment, fully hydrolyzed.

The partially hydrolyzed polyvinyl alcohol has, in one particular embodiment, a degree of hydrolization that is about 75% to about 90% (e.g., about 85% to about 90%). The partially hydrolyzed polyvinyl alcohol is a swellable component that helps inkjet print quality, through improving dry time and color density. Additionally, the partially hydrolyzed polyvinyl alcohol can help to reduce graininess, particularly when the base substrate is on a film). However, if too much of the partially hydrolyzed polyvinyl alcohol is present in the film, the solvent resistance of the printable coating can be compromised.

A crosslinking catalyst can also be present in the printable coating 18 to help ensure sufficient crosslinking occurs during curing. For example, the crosslinking catalyst can be an imidazole curing agent. However, in certain embodiments, the coating can be free from such a crosslinking catalyst.

When the printable coating 18 is directed to applications for receiving a dye-based ink via ink-jet printing, the printable coating can further include a cationic polyelectrolyte, to serve as a cationic dye fixative. When present, the printable coating can include about 0.1% by weight to about 5% by weight of the cationic dye fixative.

Other additives, such as processing agents, may also be present in the printable coating, including, but not limited to, thickeners, dispersants, emulsifiers, viscosity modifiers, humectants, pH modifiers etc. Surfactants can also be present in the printable coating to help stabilize the emulsion prior to and during application. For instance, the surfactant(s) can be present in the printable coating up to about 5%, such as from about 0.1% to about 1%, based upon the weight of the dried coating. Exemplary surfactants can include nonionic surfactants, such as a nonionic surfactant having a hydrophilic polyethylene oxide group (on average it has 9.5 ethylene oxide units) and a hydrocarbon lipophilic or hydrophobic group (e.g., 4-(1,1,3,3-tetramethylbutyl)-phenyl), such as available commercially as Triton® X-100 from Rohm & Haas Co. of Philadelphia, Pa. In one particular embodiment, a combination of at least two surfactants can be present in the printable coating.

Viscosity modifiers can be present in the printable coating. Viscosity modifiers are useful to control the rheology of the coatings in their application. For example, sodium polyacrylate (such as Paragum 265 from Para-Chem Southern, Inc., Simpsonville, S.C.) may be included in the printable coating. The viscosity modifier can be included in any amount, such as up to about 5% by weight, such as about 0.1% to about 1% by weight.

Additionally, pigments and other coloring agents may be present in the printable coating such that the printable coating provides a background color to the printable substrate. For example, the printable coating may further include an opacifier with a particle size and density well suited for light scattering (e.g., aluminum oxide particles, titanium oxide particles, and the like). These opacifiers may be additional metal-oxide particles within the polymer matrix of the printable coating. These opacifiers can be present in the printable coating from about 0.1% by weight to about 25% by weight, such as from about 1% by weight to about 10% by weight.

When it is desired to have a relatively clear or transparent printable coating, the printable coating can be substantially free from pigments, opacifying agents, and other coloring agents (e.g., free from metal particles, metalized particles, clay particles, etc.) other than the inorganic microparticles. In these embodiments, the underlying base sheet can be seen through the printable coating, except where an image is printed on the printable coating.

In one particular embodiment, the printable coating 18 can be formed by applying a printable coating precursor on the surface of the base sheet, where the printable coating precursor includes the plurality of inorganic microparticles (e.g., a first plurality of first silicon dioxide particles and a second plurality of second silicon dioxide particles), the film-forming binder mixture, the crosslinking agent, and the partially hydrolyzed polyvinyl alcohol. In one embodiment, the printable coating precursor is an aqueous mixture of the film-forming binder mixture (e.g., in a latex solution), a solution of the partially hydrolyzed polyvinyl alcohol, a dispersion of the plurality of inorganic microparticles (e.g., a first plurality of first silicon dioxide particles and a second plurality of second silicon dioxide particles) and the cationic dye fixative, and the crosslinking agent.

The printable coating precursor composition may be applied to the label substrate by known coating techniques, such as by roll, blade, Meyer rod, and air-knife coating procedures. The printable coating precursor can then be dried and cured on the surface to crosslink the film-forming binder mixture and the partially hydrolyzed polyvinyl alcohol. While some heat may be applied to dry the precursor (i.e., enough heat to remove water and any other solvents), heat is not necessary for curing in particular embodiments. As such, curing can be achieved at room temperature (e.g., about 20° C. to about 25° C.). However, applying heat for curing may increase the time required for curing of the coating.

In particular embodiments, the coating technique is an application method requiring relatively low viscosity (e.g., roll, blade, Meyer rod, and air-knife coating procedures). In such embodiments, the viscosity of the printable coating can be about 100 to about 200 centipoise (cP). The relatively low viscosity is generally believed to be generated by the presence of the partically hydrolyzed polyvinyl alcohol in the printable coating precursor composition.

Alternatively, the printable coating may be a film laminated to the base sheet. The resulting printable substrate then may be dried by means of, for example, steam-heated drums, air impingement, radiant heating, or some combination thereof. The printable coating can, in one particular embodiment, be formed by applying a polymeric emulsion onto the surface of the base sheet, followed by drying. Likewise, an adhesive layer, when present, may be applied to the opposite surface of the base sheet by any technique.

The basis weight of the printable coating 18 generally may vary from about 2 to about 70 $g/m^2$, such as from about 3 to about 50 $g/m^2$. In particular embodiments, the basis weight of the printable coating may vary from about 5 to about 40 $g/m^2$, such as from about 7 to about 25 $g/m^2$.

II. Printable Substrates

Figure 2:
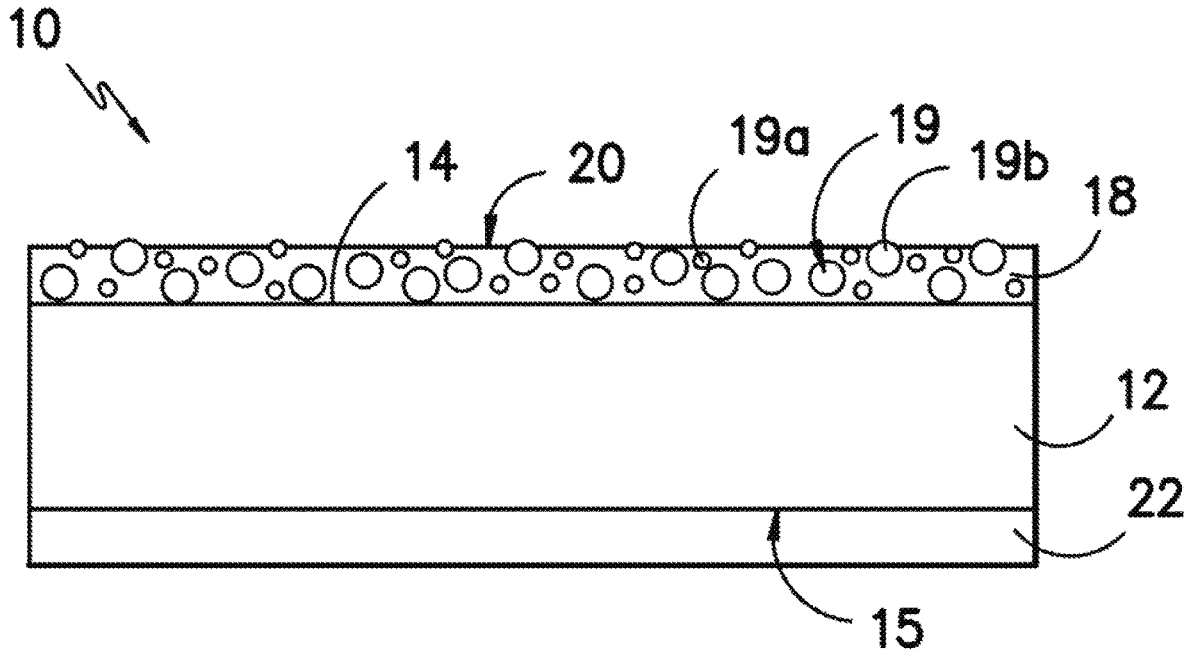
FIG. 2 shows an exemplary printable label substrate 10 having a printable coating 18 on a first surface 14 of the base sheet 12 and an adhesive layer 22 on the opposite surface of the base sheet (i.e., the second surface 15)

FIG. 1 shows an exemplary printable substrate 10 having a printable coating 18 as described above. The printable coating 18 defines an external, printable surface 20 of the printable substrate 10. The printable coating 18 is shown overlying the first surface 14 of the base sheet 12. In the embodiment of FIG. 2, an adhesive layer 22 is shown overlying the opposite, second surface 15 of the base sheet 12. Although shown with an adhesive layer 22 in FIG. 2, the printable substrate 10 can employ any available connector to attach the coated label substrate to the material/product to be labeled. Other suitable connectors include, for example, ties (e.g., wires, cords, strings, ropes, and the like), tape (e.g., the use of tape to secure the label substrate to the product), etc.

The printable coating 18 is shown in the exemplary embodiment of FIG. 1 as directly overlying the first surface 14 of the base sheet 12 (i.e., no intermediate layer exists between the first surface 14 of the base sheet 12 and the printable coating 18). Likewise, the adhesive layer 22 is shown in the exemplary embodiment of FIG. 2 as directly overlying the second surface 15 of the base sheet 12 (i.e., no intermediate layer exists between the second surface 15 of the base sheet 12 and the adhesive layer 22). In other embodiments, however, an intermediate layer(s) could be present between the base sheet 12 and the printable coating 18 and/or between the base sheet 12 and the adhesive layer 22.

The base sheet is generally flexible and has first and second surfaces. For example, the label substrate can be a film (e.g., a polymeric film) or a cellulosic nonwoven web. In addition to flexibility, the base sheet also provides strength for handling, coating, sheeting, and other operations associated with the manufacture thereof. The basis weight of the label substrate generally may vary, such as from about 30 to about 250 g/m$^2$ (e.g., about 40 to about 150 g/m$^2$). Suitable base sheet include, but are not limited to, cellulosic nonwoven webs and polymeric films. In particular embodiments, the base substrate is a polymeric film formed from polypropylene, polyethylene, or a laminate thereof (e.g., having a center core of polypropylene and outer shell of polyethylene).

The adhesive layer 22 can be a pressure sensitive adhesive, a glue applied or wet adhesive, or any other type of suitable adhesive material. For example, the adhesive layer can include natural rubber, styrene-butadiene copolymers, acrylic polymers, vinyl-acetate polymers, ethylene vinyl-acetate copolymers, and the like.

Figure 3:
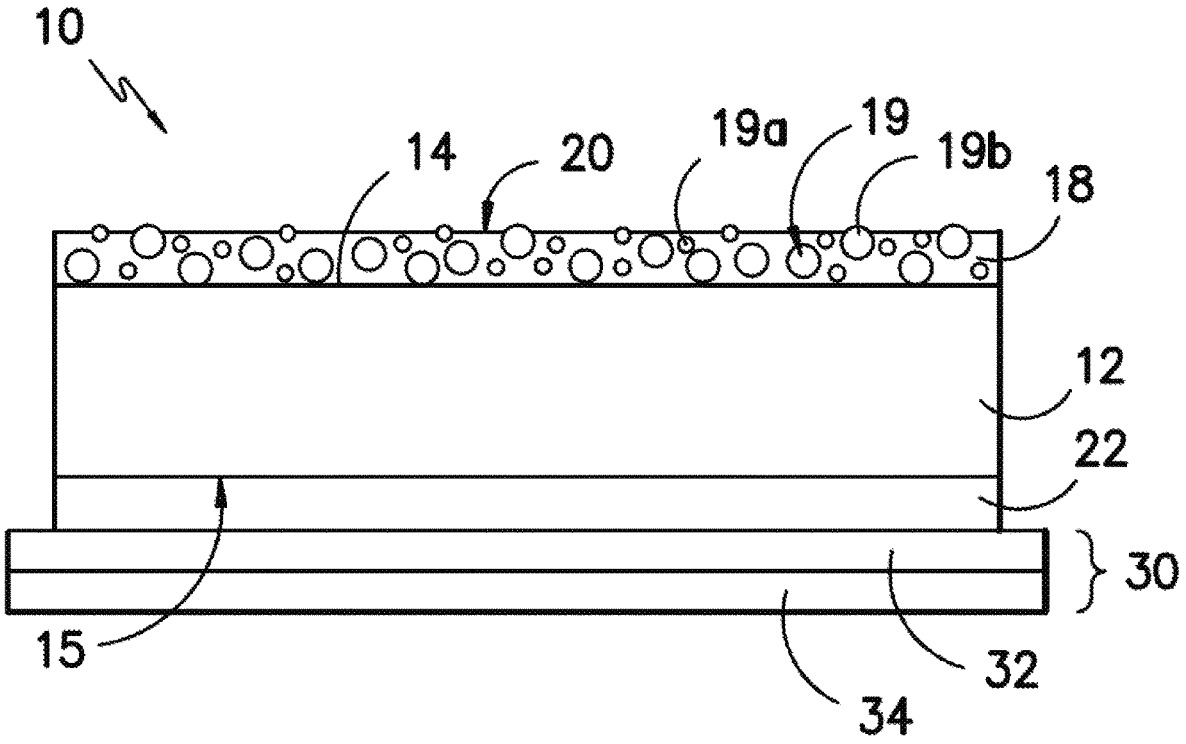
FIG. 3 shows the exemplary printable label substrate 10 of FIG. 2 attached to a releasable sheet 30.
Figure 4:
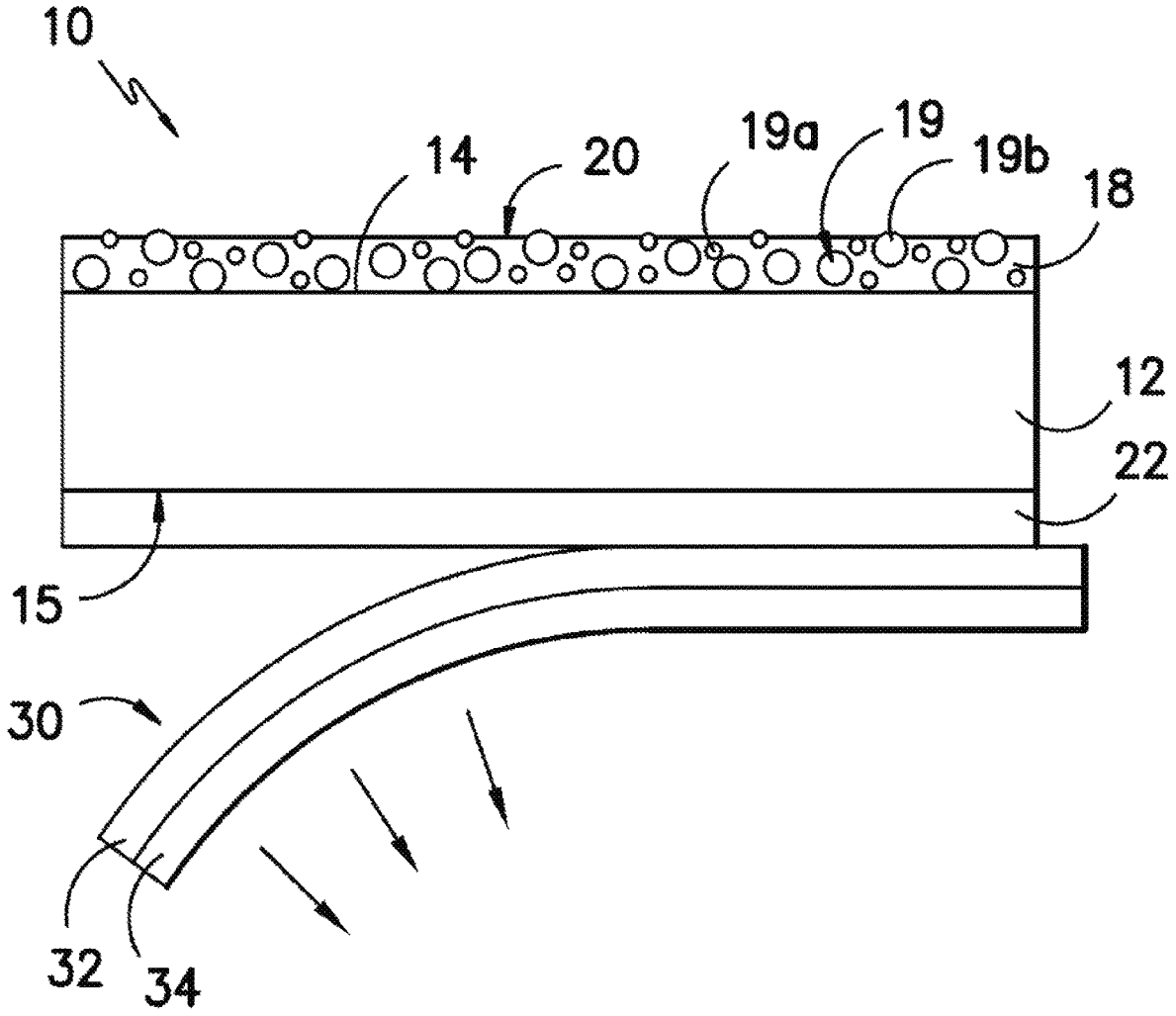
FIG. 4 shows removal of the releasable sheet 30 from the exemplary printable label substrate 10 of FIG. 2 exposing the adhesive layer 22.

FIGS. 3 and 4 show a releasable sheet 30 can be attached to the printable substrate 10 to protect the adhesive layer 22 until the printable substrate 10 is to be applied to its final surface. The releasable sheet 30 includes a release layer 32 overlying a base sheet 34. The release layer 32 allows the releasable sheet 30 to be released from the printable substrate 10 to expose the adhesive layer 22 such that the printable substrate 10 can be adhered to its final surface via the adhesive layer 22.

The base sheet 34 of the releasable sheet 30 can be any film or web (e.g., a paper web). For example, the base sheet 34 can be generally manufactured from any of the materials described above with regards to the label substrate.

The release layer 32 is generally included to facilitate the release of the releasable sheet 30 from the adhesive layer 22. The release layer 32 can be fabricated from a wide variety of materials well known in the art of making peelable labels, masking tapes, etc. Although shown as two separate layers in FIGS. 3-4, the release layer 32 can be incorporated within the base sheet 34, so that they appear to be one layer having release properties.

To apply the label to a surface, the releasable sheet is first separated from the coated label substrate to expose the adhesive layer of the coated label substrate. The releasable sheet can be discarded and the coated label substrate can be adhered to a surface via the adhesive layer.

III. Printing onto the Printable Coating of the Printable Substrate

An image can be formed on the printable coating of the coating label substrate by printing an ink composition onto the printable coating. In particular, ink-jet printing methods can print the ink composition to the printable coating. Ink-jet inks can typically be pigment based inks (e.g., Durabrite® inks by Epson), dye-based inks (e.g., Calria® inks by Epson), water-based inks that are sublimation inks sensitive to heat but are still classified as dyes (e.g., such as available from Sawgrass Technology).

Figure 5:
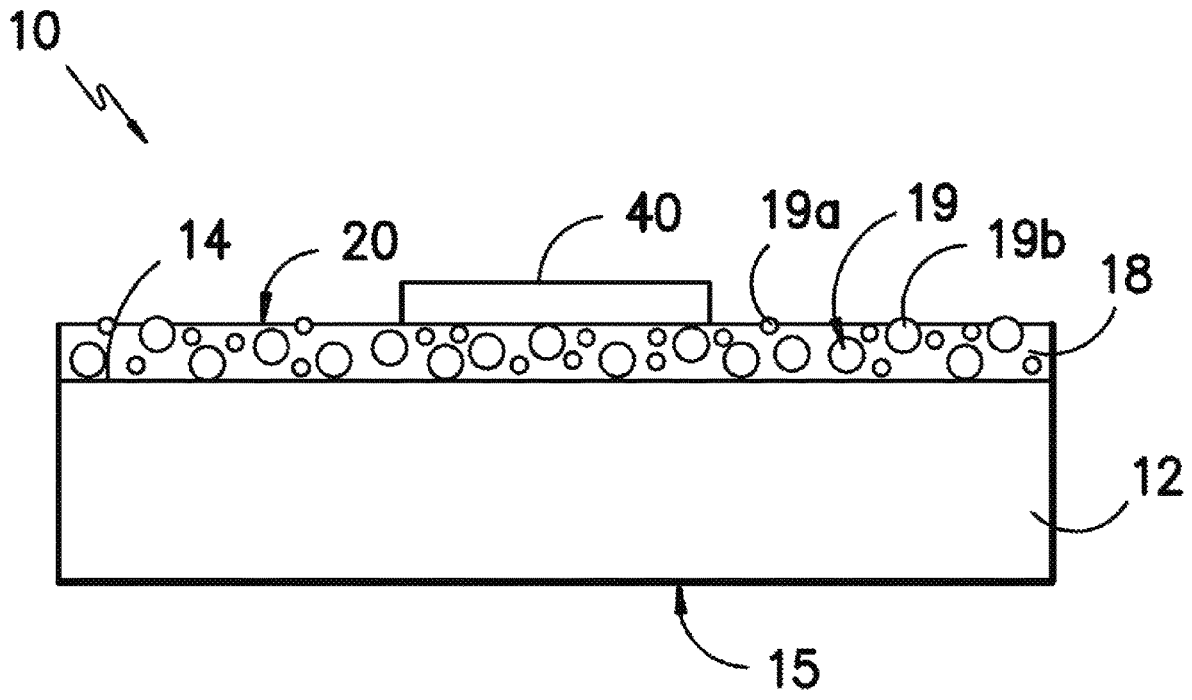
FIG. 5 shows an ink composition 40 applied to the exemplary printable substrate 10 of FIG. 1.
Figure 6:
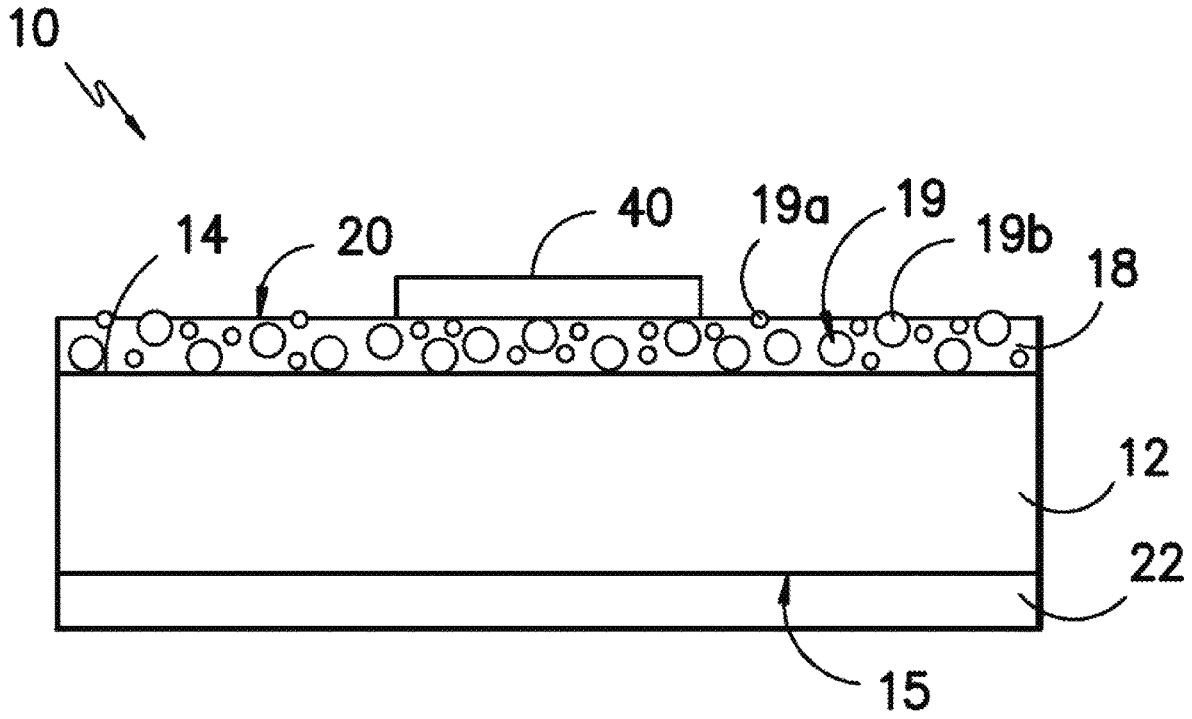
FIG. 6 shows an ink composition 40 applied to the exemplary printable substrate 10 of FIG. 2.

FIGS. 5-6 show an ink composition 40 on the printable coating 18 of the printable substrate 10. The ink composition can form any desired image desired on the printable coating. Typically, the composition of the ink composition will vary with the printing process utilized, as is well known in the art.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A printable substrate comprising a base sheet defining a first surface and a second surface; and a printable coating on the first surface, wherein the printable coating comprises a film-forming binder mixture, a crosslinking agent, a partially hydrolyzed polyvinyl alcohol, a first plurality of first silicon dioxide microparticles, a second plurality of second silicon dioxide microparticles, and a cationic dye fixative, wherein the film-forming binder is present in an amount of 65% by weight or greater, based on the weight of the printable coating.

2. The printable substrate as in claim 1, wherein the first silicon dioxide microparticles and the second silicon dioxide microparticles have a different surface area from each other.

3. The printable substrate as in claim 1, wherein the film-forming binder mixture comprises a urethane component, an acrylic component, and a polyvinyl alcohol component.

4. The printable substrate as in claim 3, wherein the acrylic component comprises an ethylene acrylic polymer.

5. The printable substrate as in claim 3, wherein the polyvinyl alcohol component comprises a fully hydrolyzed polyvinyl alcohol component.

6. The printable substrate as in claim 1, wherein the first silicon dioxide microparticles have an average diameter that is smaller than an average diameter of the second silicon dioxide microparticles.

7. The printable substrate as in claim 1, wherein the first silicon dioxide microparticles have an average diameter of from about 3 μm to about 7 μm, and wherein the second silicon dioxide microparticles have an average diameter of from about 8 μm to about 12 μm.

8. The printable substrate as in claim 1, wherein the first plurality of silicon dioxide microparticles constitute about 60% to about 80% of a total weight of all of the inorganic microparticles present in the printable coating, and wherein the second plurality of silicon dioxide microparticles constitute about 20% to about 40% of a total weight of all of the inorganic microparticles present in the printable coating.

9. The printable substrate as in claim 1, wherein printable coating is substantially free from any additionally inorganic microparticles than a first plurality of first silicon dioxide microparticles and the second plurality of second silicon dioxide microparticles.

10. The printable substrate as in claim 1, wherein the printable substrate has a gloss level of about 50 to about 60 based on measurement of a gloss meter set with an angle of measurement of 75 degree on the external surface of the printable coating.

11. The printable substrate as in claim 1, wherein the base sheet comprises a polymeric film.

12. The printable substrate as in claim 1, further comprising an ink composition applied to an external surface of the coated label substrate formed by the printable coating, wherein the ink composition defines an image on the external surface.

13. The printable substrate as in claim 1, wherein the printable coating directly overlies the first surface of the base sheet without any intermediate layer present between the printable coating and the first surface.

14. The printable substrate as in claim 1, further comprising:

a connector configured to attach the printable substrate to a product for labeling, wherein the connector is an adhesive layer overlying the second surface of the base sheet.

15. The printable substrate as in claim 1, wherein the printable coating defines an external surface of the printable substrate.

16. A method of forming an image on a printable substrate, the method comprising:

printing an ink composition onto the external surface of the printable substrate of claim 15.

17. A printable coating precursor composition, comprising: a film-forming binder mixture, a crosslinking agent, a partially hydrolyzed polyvinyl alcohol, a first plurality of first silicon dioxide particles, a second plurality of second silicon dioxide particles, a cationic dye fixative, and water, wherein the film-forming binder is present in an amount of 65% by weight or greater, based on the weight of the printable coating precursor composition.

18. The printable coating precursor of claim 17, wherein the printable coating precursor has a viscosity of about 100 cP to about 200 cP, and wherein the first silicon dioxide microparticles and the second silicon dioxide microparticles have a different surface area from each other.

19. A method of forming a printable substrate, the method comprising:

applying the printable coating precursor of claim 17 onto a surface of a base substrate; and curing the printable coating precursor to crosslink the film-forming binder mixture and the partially hydrolyzed polyvinyl alcohol.

20. The method of claim 19, wherein the printable coating precursor is applied via a rod coating technique.

21. The printable substrate as in claim 1, wherein the partially hydrolyzed polyvinyl alcohol is present in an amount of from about 5% by weight to about 25% by weight of the printable coating.

22. The printable substrate as in claim 1, wherein the microparticles are present in an amount of 10% by weight or less, based on the weight of the printable coating.

23. A printable substrate comprising a base sheet defining a first surface and a second surface; and a printable coating on the first surface, wherein the printable coating comprises a film-forming binder mixture, a crosslinking agent, a partially hydrolyzed polyvinyl alcohol, a first plurality of first silicon dioxide microparticles, a second plurality of second silicon dioxide microparticles, and a cationic dye fixative, wherein the microparticles are present in an amount of 10% by weight or less, based on the weight of the printable coating.

* * * * *